United States Patent [19]

Kühn

[11] Patent Number: 4,633,684

[45] Date of Patent: Jan. 6, 1987

[54] KNITTING MACHINE HAVING AT LEAST ONE NEEDLE BED

[75] Inventor: Falk Kühn, Rottenburg, Fed. Rep. of Germany

[73] Assignee: Memminger GmbH, Freudenstadt, Fed. Rep. of Germany

[21] Appl. No.: 840,505

[22] Filed: Mar. 17, 1986

[30] Foreign Application Priority Data

Mar. 20, 1985 [DE] Fed. Rep. of Germany ..... 3510054

[51] Int. Cl.[4] ..... D04B 15/06

[52] U.S. Cl. ..... 66/104; 66/106

[58] Field of Search ..... 66/104, 106

[56] References Cited

U.S. PATENT DOCUMENTS

| | | | |
|---|---|---|---|
| 4,018,063 | 4/1977 | Buck | 66/104 |
| 4,532,781 | 7/1985 | Buck . | |
| 4,546,626 | 10/1985 | Kühn | 66/104 |
| 4,584,851 | 4/1986 | Plath | 66/106 |

FOREIGN PATENT DOCUMENTS

| | | |
|---|---|---|
| 3247767 | 7/1984 | Fed. Rep. of Germany . |
| 1505737 | 3/1978 | United Kingdom . |
| 2132234 | 4/1984 | United Kingdom . |
| 2137233 | 10/1984 | United Kingdom . |
| 2158106 | 11/1985 | United Kingdom . |

*Primary Examiner*—Ronald Feldbaum

*Attorney, Agent, or Firm*—Frishauf, Holtz, Goodman & Woodward

[57] ABSTRACT

A knitting machine has at least one needle bed equipped with longitudinally displaceable needles controlled by a needle cam curve, and between the needles are protruding sinkers controlled by a sinker cam curve. The sinkers are movably supported in at least the longitudinal direction of the needles and being controlled such that at a given feed, after the locking in of the yarn, they are moved counter to the lowering movement of the associated needles and after casting off of the loop are moved counter to the needle raising movement. The needle and sinker cam curves have adjoining steadily curved arc portions that in the case of the needle cam curve are sinusoidal and merge steplessly with one another. To reduce noise and wear, especially at very high knitting speeds, the sinker cam curve is substantially sinusoidal, at least in the loop forming zone.

14 Claims, 9 Drawing Figures

KNITTING MACHINE HAVING AT LEAST ONE NEEDLE BED

Reference to related patent, assigned to the assignee of the present application, the disclosure of which is hereby incorporated by reference: U.S. Ser. No. 06/634,789, filed July 26, 1984, BUCK and KUHN, allowed Mar. 17, 1986, issue fee paid Apr. 23, 1986.

The invention relates to a knitting machine having at least one needle bed, which is equipped with longitudinally displaceable needles controlled by a needle cam curve. Sinkers controlled by a sinker cam curve protrude between the needles.

BACKGROUND

In such machines, the sinkers are movably supported in the longitudinal direction of the needles and controlled such that they are moved at a given feed after locking in of the yarn counter to the pull-off direction of the associated needles and after knocking over of the loop counter to the needle raising direction. The needle cam curve and the sinker cam curve have adjoining, steadily curved arc portions; in the case of the needle cam these portions are sinusoidal and merge smoothly, or steplessly, with one another.

Knitting machines in which the locking-in and knock-over sinkers are controlled in the longitudinal direction of the needles contrary to the direction of needle movement make it possible to attain a very high knitting speed while producing goods of excellent quality. This is because the paths of movement of the needles are relatively short, and so the associated needle cam curves can have correspondingly little slope. To prevent abrupt impacts on the latch needles as much as possible and to prevent transmitting vibration to them, the use of a needle cam curve that comprises steadily curved, sinusoidal arc portions that merge steplessly with one another is known from German Patent DE-PS No. 31 08 041. Thus especially in the areas of their motion reversal points the needles are accelerated or decelerated particularly gently, which reduces the stress on the needles caused by impact waves accordingly.

The sinker cam curve of this known knitting machine is also made up of steadily curved arc portions, but they are connected to one another by arc portions having a shorter radius of curvature, and so the overall result is an undulating sinker cam curve. This shape of the sinker cam curve is the product of the realization that the sinkers together with the needles, over the length of the new loop that has been drawn through the old loop, should hold the just-formed loops over at least two adjacent needle slots, and to do so the needles and sinkers must then execute a pull-off movement in the same direction up to the maximally lowered height of the sinkers. Since the reversal of the sinkers in the region of draw-through of the new loop must be effected relatively fast, because during this time the needles are continuing their lowering movement uninterruptedly, the radius of curvature of the arc portions of the sinker cam having the shorter radius of curvature is necessarily relatively short. Although the acceleration which the sinkers undergo in this reversal is substantially less than that occurring with sinker curves having angles or other irregularities, still the peaks of acceleration that occur at very high knitting speeds can make themselves apparent in the form of increased noise. This noise, however, is again associated with wear.

THE INVENTION

It is an object to improve a knitting machine of the above type such that it is distinguished by a lower noise level and little wear, in particular even at very high knitting speeds.

Briefly, the sinker cam curve if formed substantially as a sine wave, at least in the area where the new loops are drawn through the old ones.

As a result, there is smooth acceleration and deceleration of the sinkers in this critical loop forming zone; this enables a further increase in knitting speed while reducing wear and producing less noise, while on the other hand, in the case of operation at low knitting speed, noise and wear can be reduced to a minimum. As a result of the novel form of the cam curves, in which the critical reversal of the sinkers at the point of draw-through of the loops takes place in a flat and harmonious manner, and both the needles and the sinkers are moved in a substantially sinusoidal pattern in the loop forming zone, a certain "robbing-back" effect while forming loops is attained, by robbing back a certain minimal quantity of yarn from the loops already formed. Together with the pre-drawing of the loops via a needle and two sinkers, this robbing back effect further contributes to uniform loop formation.

In a preferred embodiment, the needle cam and sinker cam curves are substantially continuously sinusoidal and have the same period length, and the two sinusoidal cam curves are each located with their maximal amplitudes on a common line in the longitudinal direction of the needle; that is, the two sine curves are out of phase with one another by 180°. However, in principle the needle and sinker cam curves may also be axially displaceable counter to one another, and depending on the requirements in a given case they may also be offset from one another by a predetermined amount. It has proved to be advantageous for the two cam curves to be offset counter to one another by the amount of two to three needle slots.

With this mutual offset, the zone in which the new loop is drawn through the old can be varied, in a manner that will be described in further detail below.

If fully extended loops over a predetermined area, defined by successive needles and sinkers, are intended to be maintained in their length in the loop forming zone, for technical reasons, then at least in this loop forming zone the needle cam curve may have a substantially straight curved portion that merges smoothly with the adjoining arc portion and is located in the area of greater amplitude. Especially to facilitate cam manufacture, the needle and/or sinker cam curves may have sinusoidal arc portions, which are connected to one another by substantially straight curved portions, at least in the area of reversal of the associated needles or sinkers that is located outside the loop forming zone.

The period lengths of the substantially sinusoidal needle and sinker cam curves may be approximately half the length of one knitting feed. However, it may also be suitable for them to be approximately equal to the entire length of one knitting feed.

The novel embodiment of the sinker cam curve, in cooperation with the harmonic needle cam curve, and with very short raising distances for the needles and sinkers, enables attaining the same extension that the length of the needle latches provides in latch needles.

The needle raising distance may be approximately equal to or shorter than the flipping distance of the needle latch, while on the other hand the amplitude of the substantially sinusoidal needle cam curve may be equal to or greater than the amplitude of the sinker cam curve.

Correspondingly, it is equally possible in principle for a knitting machine that functions with compound needles to be embodied such that the slider of the needle is then controlled by a slider cam curve having intermittent portions that are substantially sinusoidal. As a result, the slider movement is harmonic as well; that is, the slider is not subjected to excessively high acceleration or deceleration. It has proved to be advantageous if half the period length of the half-sine wave of the slider cam curve that controls the needle raising motion of the slider is at least twice as large as one-half the period length of the half-sine wave that controls the needle lowering motion of the slider.

DRAWING

Figure 1:
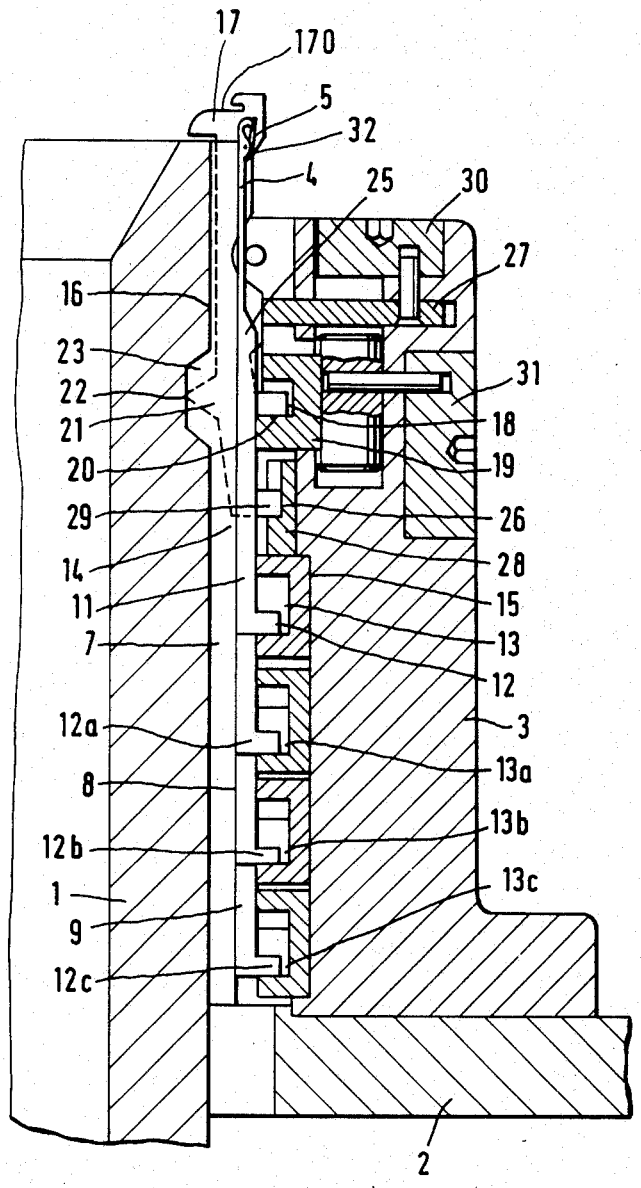
FIG. 1 shows a circular knitting machine according to the invention in an axial section taken through the needle cylinder and the associated cam casing, in a fragmentary side view.
Figure 6:
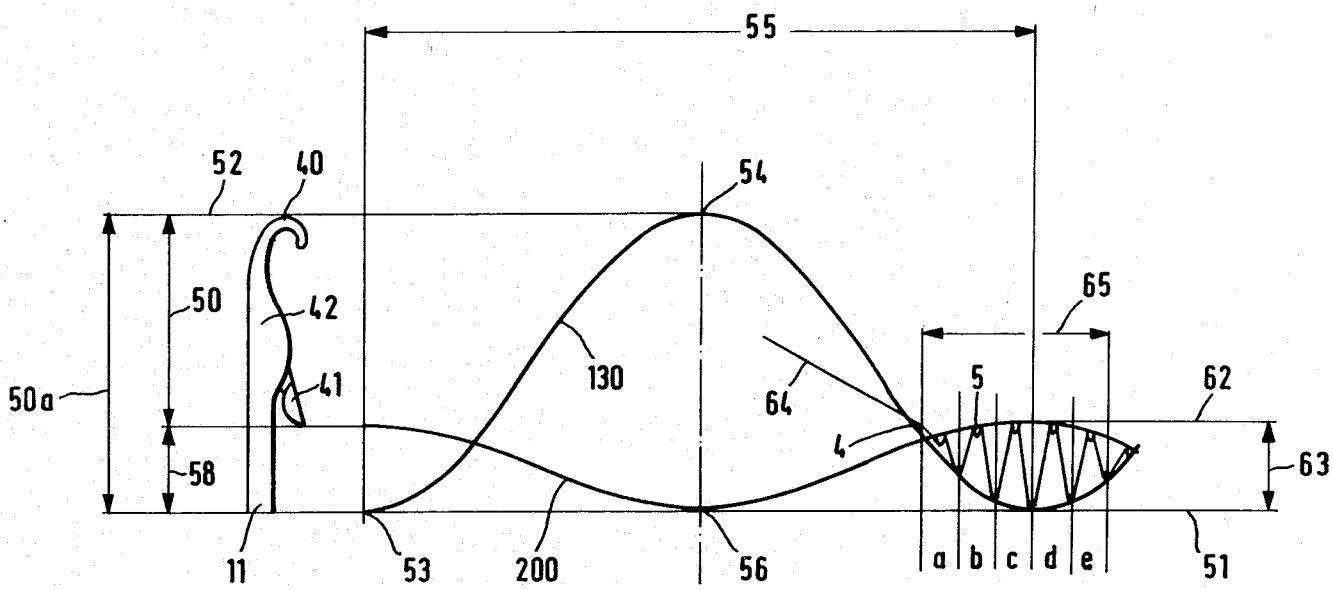
Figure 7:
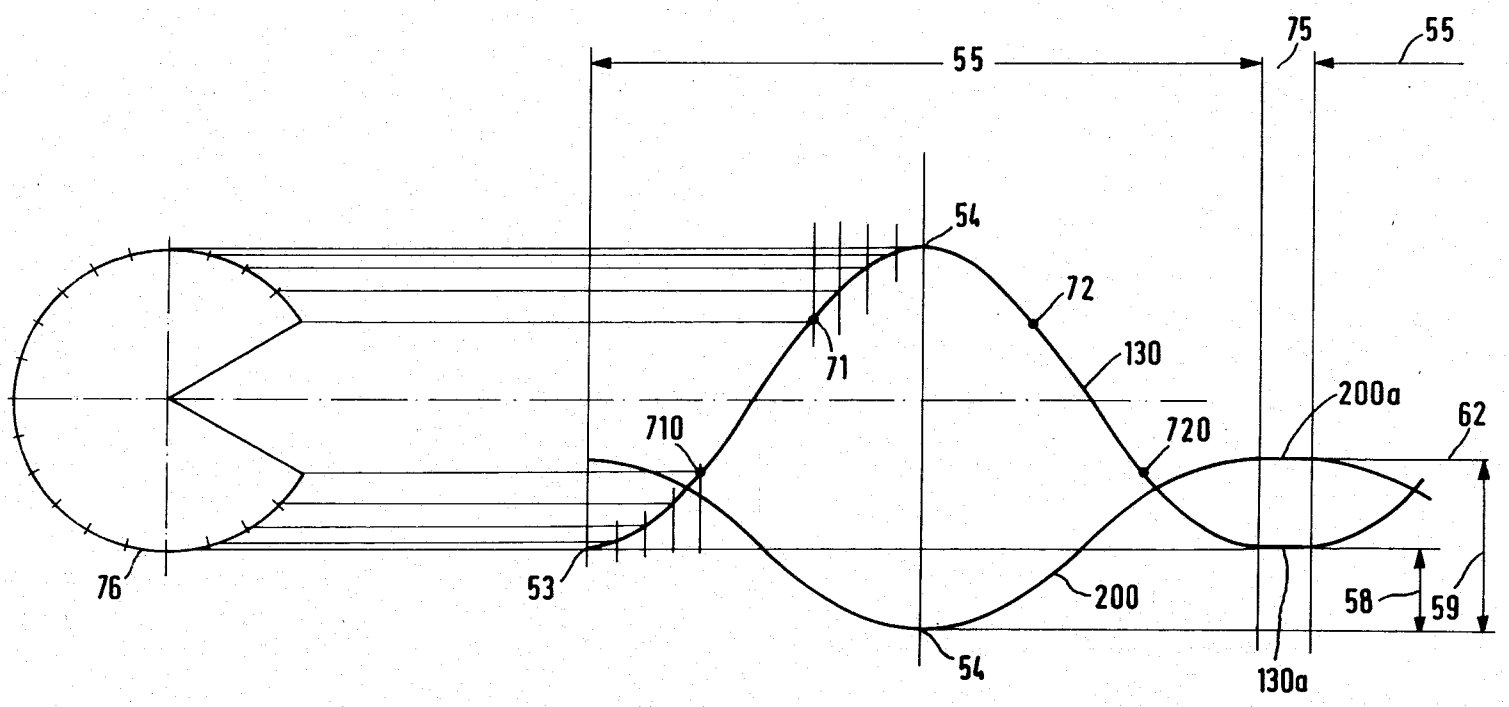
Figure 8:
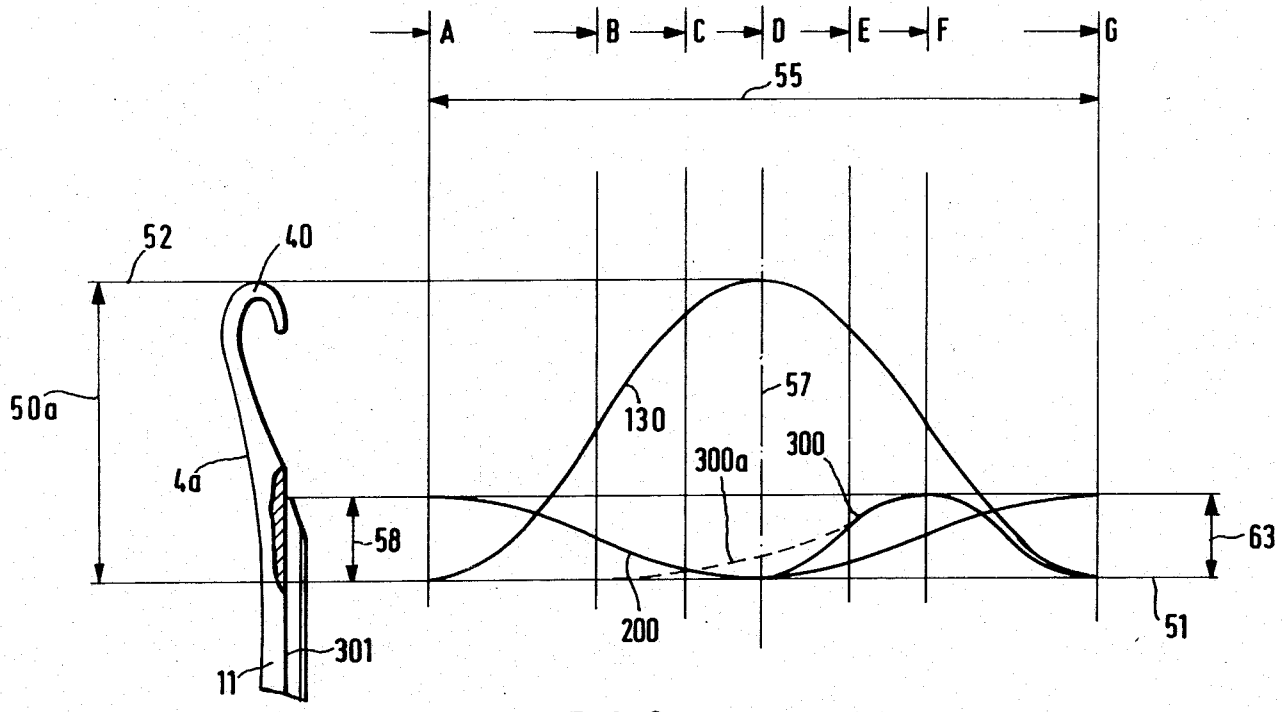
Figure 9:
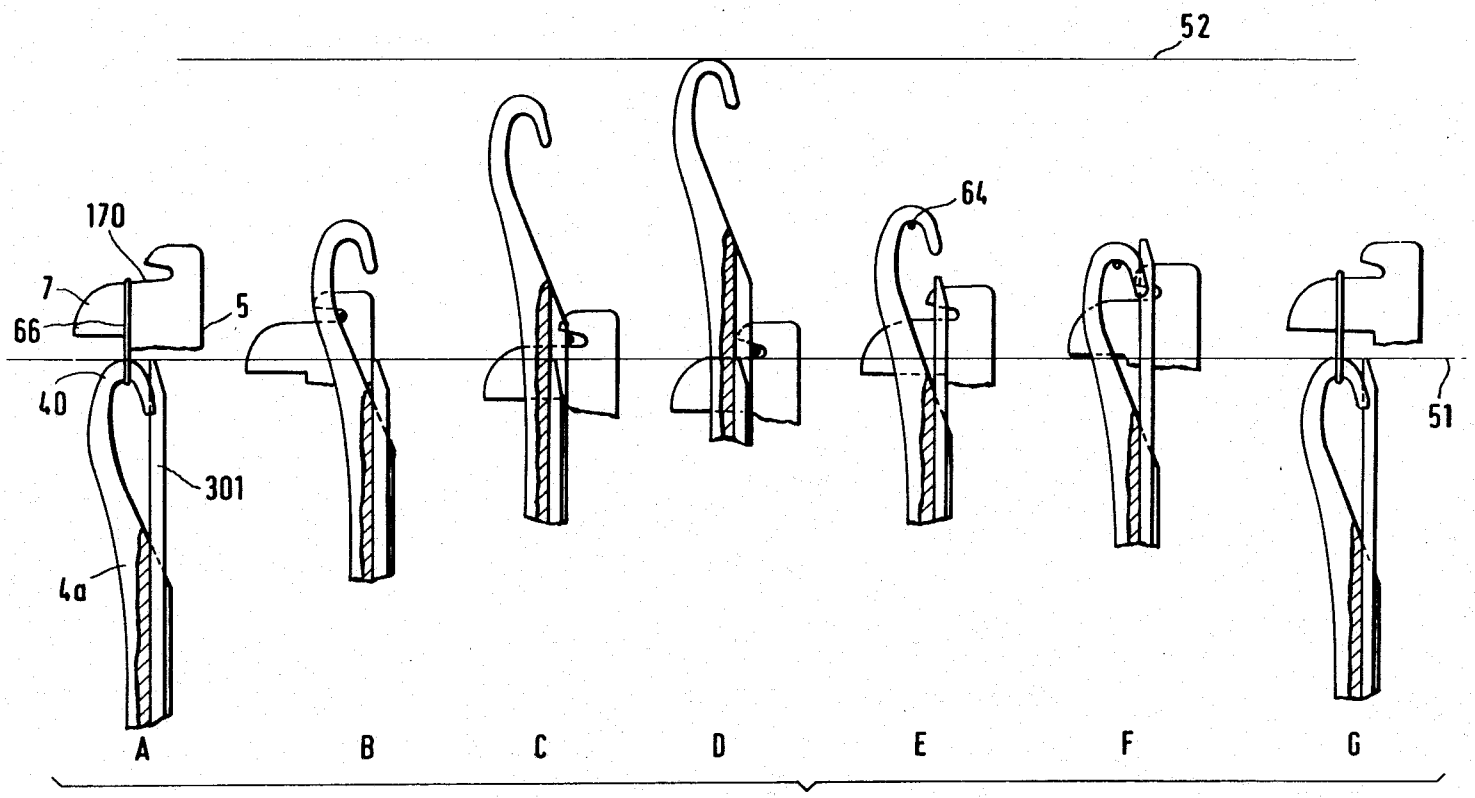

FIG. 8, in a view corresponding to that of FIGS. 2–7, shows the needle cam curve, the sinker cam curve and the slider cam curve of a circular knitting machine according to the invention and similar to FIG. 1 but equipped with compound needles; and FIG. 9 is a schematic side view of a detail of the compound needle controlled by the cams of FIG. 8, showing the various phases of movement during the process of drawing the new loop through the old loop.

DETAILED DESCRIPTION

FIG. 1 shows the needle cylinder 1 of the circular knitting machine, which is rotatably supported in the conventional manner about a vertical axis in a stationary ring frame 2 and is set into rotation by a drive mechanism, not shown. A cylindrical cam casing 3 is secured on the ring frame 2, having control elements on its side facing the needle cylinder 1 for latch needles shown at 4 and locking-in and knockover sinkers shown at 5.

Longitudinal ribs 7 are inserted into appropriate radial grooves of the needle cylinder 1, the grooves extending longitudinally and being spaced apart at the same intervals as the sinkers; on its side facing radially outward, each longitudinal rib 7 is provided with a guide face 8, on which a latch needle 4 is supported with its shaft 11 30 in a longitudinally displaceable manner. Auxiliary ribs 9 are secured such that they rest laterally on the longitudinal ribs 7; however, the auxiliary ribs 9 extend over only part of the length of the longitudinal ribs 7 and are provided only in the lower portion of the needle cylinder 1. One needle guide groove, in which the shaft 11 of a latch needle is laterally guided, is defined by each two adjacent auxiliary ribs 9.

The latch needles 4 are provided on their shafts with at least one butt 12, which engages a corresponding needle cam race 13 located on the inside of the cam casing 3 and shaped to match the associated needle cam; this needle cam race 13 controls the longitudinal movement of the needles 4.

A plurality of needle cam races 13, 13*a*, 13*b*, 13*c* are provided on the cam casing 3, cooperating with corresponding butts 12, 12*a*, 12*b*, 12*c* of the needles 4; the shafts 11 of the needles 4 have different lengths, so that the various needle types are assigned to the individual needle cam races 13–13*c*, as is already known per se for pattern selection.

The auxiliary ribs 9 end at 14, somewhat above a needle cam portion 15 defining the uppermost cam race 13. The locking-in and knockover sinkers, the shafts 16 of which are each formed as a double-armed lever, are located above the auxiliary ribs 9. On its end remote from the sinker head 17, each sinker shaft 16 has a sinker butt 18 protruding radially outward, which cooperates with a sinker cam 20 formed on the inside of the cam casing 3 in a sinker cam portion 19. The sinker cam 20 controls a longitudinal movement of the locking-in and knockover sinkers 5 that is executed in the longitudinal direction of the needles.

On the side remote from the sinker butt 18, each sinker shaft 16 has a protruding, approximately triangular bearing projection 21, which is supported with a rohnded bearing face 22 on the bottom of an annular groove 23 cut into the needle cylinder 1, thereby forming a pivoting, or fulcrum point; thus the locking-in and knockover sinker 5 is pivotable about a horizontal pivot axis, in the course of which the sinker head 17 executes a transverse reciprocating movement substantially at right angles to the longitudinal movement of the needles.

This transverse movement is generated by two sinker control cam faces 25, 26 located on the inside of the cam casing 3 on sinker cam portions 27, 28, of which one sinker cam portion 28 and its sinker control cam face 26 engage a control butt 29 or the shaft 16 of the associated locking-in and knockover sinker below the bearing projection 21, and the other sinker cam portion 27 and its sinker control cam face 25 engage the control butt 29 or shaft 16 above the bearing projection 21. At least the upper sinker cam portion 27 is adjustable via an externally actuatable eccentric adjusting mechanism 30, while for axial adjustment of the sinker cam portion 19 that generates the longitudinal sinker movement, a likewise externally actuatable eccentric adjusting mechanism 31 is provided. The two adjusting mechanisms 30, 31 enable adjustment of the longitudinal and transverse movement of the locking-in and knockover sinkers 6 to meet with given needs.

Thus the needles 4, with their needle shafts 11, are laterally guided in the region above the auxiliary ribs 9 by the locking-in and knockover sinkers 5, or more precisely by their sinker shafts 16, while in the region below this, where the needle butts 12 are located, the needle shafts 11 are laterally guided by the auxiliary ribs 9 in the manner already described above.

The control of the raising and lowering movement of the latch needles 4 and of the longitudinal movement of the locking-in and knockover sinkers 5 in the longitudinal direction of the needles is done by the needle and sinker cam curves 130 and 200, respectively, various embodiments of which are shown in FIGS. 2–7. The control of the transverse movement of hte locking-in and knockover sinkers has been described per se in German Patent DE-PS No. 33 30 530, to which U.S. Ser. No. 06/634,789, filed July 26, 1984, Buck and Kuhn, corresponds. It will therefore not be explained in further detail herein.

Figure 2:
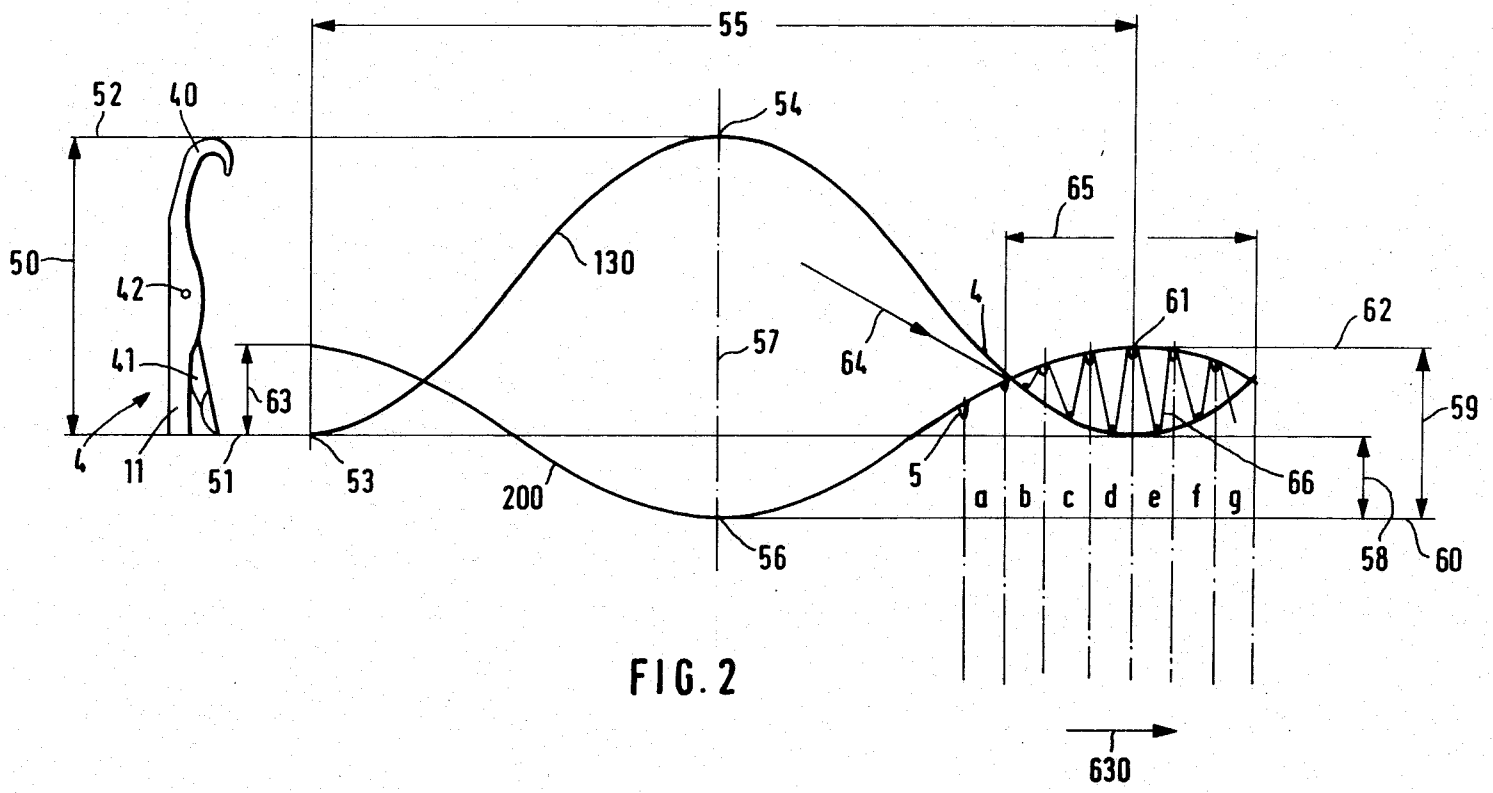
FIGS. 2–7 show developed, detail views of various embodiments of a needle cam curve and sinker cam curve of the circular knitting machine of FIG. 1, seen over the length of approximately one feed system.

As seen in FIG. 2, the latch needle 4 is movable in its longitudinal motion by the length of a needle path 50, which extends between a lowermost point located on a line 51 and an uppermost point located on a line 52. If the latch needle 4 is touching the lower line 51 with its needle hook 40, the latch needle 4 is in its non-knitting base position; if the hook 40 is touching the upper line 52, then the latch needle is in its fully raised position. The needle path 50 is equal to the flipping distance of the latch of the latch needle 4; for better comprehension, this is shown in FIGS. 2–7 laterally beside the needle cam curve 130 and sinker cam curve 200. The needle latch is shown at 41 and is pivotable about a pivot axis 42 in a manner known per se for latch needles.

Between the two extreme points 53, 54 located on the lines 51, 52, corresponding to the base position and the fully raised position, the movement of the latch needle 4 follows the needle cam curve 130, which in FIG. 2 has a sinusoidal or in other words harmonic course that in FIG. 2 (as well as in FIGS. 3–9) is shown approximately over a period length 55 that is equivalent to the length of one feed system. In the embodiment of FIG. 2, the amplitude of this sine curve is selected such that twice the amplitude of the needle cam curve 130 is equal to the latch flipping distance of the latch needle 4 and thus to the needle path 50.

The sinker cam curve 200 is also a purely sinusoidal or harmonious curve, which is out of phase with the sinusoidal needle cam curve 130 by 180°; thus the needle cam 130 and the sinker cam curve 200 are each located with their respective maximal amplitude values 54 and 56 on a common imaginary line 57, which extends on the needle cylinder in the longitudinal direction of the needles.

The sinusoidal sinker cam curve 200 is positioned such that when the locking-in and knockover sinkers 5 are in their lowermost position, on the point 56, the loop forming edge 170 (see FIG. 1) of the locking-in and knockover sinkers 5, which follows the sinker cam curve 200, is located at the point 56, which is disposed a safe distance 58 below the line 51, and thus is located that far below the tip of the opened latch 41 of the latch needle 4 which is in its lowermost position. The sinker path 59 extends between a line 60, which includes the lower extreme point 56 corresponding to the sinker located in its lowermost position, and a line 62, which includes the upper extreme point 61 of the sinker located in its most fully raised position. This point 61 is the sum of the safe distance 58 and the maximal loop length 63.

In the course of the movement of the needle cylinder 1 indicated by an arrow 630, in which the latch needles 4, in the course of their lowering movement that begins at the fully raised position 54, trace the needle cam curve 130, the opened hooks 40 of the latch needles 4 draw in the yarn 64, which is guided by a yarn guide; in cooperation with the locking-in and knockover sinkers 5, the latch needles 4 form the yarn 64 into yarn loops 66 in the loop-forming zone 65.

For better understanding of this loop forming process, the loop forming zone 65 is divided into various zone segments b–g in FIG. 2, while another segment a is located prior to the actual loop forming process. Each of these segments a–g corresponds to a given machine cut; for example, a cut 28 representing 28 needles and 28 locking-in and knockover sinkers per inch of circumference of the needle cylinder; in other words, each segment a–g corresponds to one needle or sinker slot.

In the first segment a, a latch needle 4 begins to draw in the yarn 64 with its hook 40, while the adjacent locking-in and knockover sinkers 5, with their loop forming edge 170, are guided along the yarn 64 and brought into contact with it.

In segment b, the latch needle 4 is just beginning to form a loop 66, while the yarn 64 rests on the loop forming edge 170 of the locking-in and knockover sinker 5 adjoining it on the left. The latch needle located in segment c is pre-forming the yarn 64 into a loop; this is not a problem because only slight frictional resistance occurs on the loop forming edges 170 of the adjoining locking-in and knockover sinkers 5.

In segment d, the latch needle 4 located there has already drawn out the yarn into a loop 66 having the full loop length 63. In the next segment e, the yarn loop 66 maintains approximately the same maximal loop length that was attained in segment d. Then yarn material can be robbed back to a slight extend from the already formed loop of segment f; as a result, the loop in this segment f attains it final loop length; simultaneously, the tension on the yarn is evened out, which makes for uniform quality of the knitted goods. In segment g, finally, the loop forming process is completed.

Figure 3:
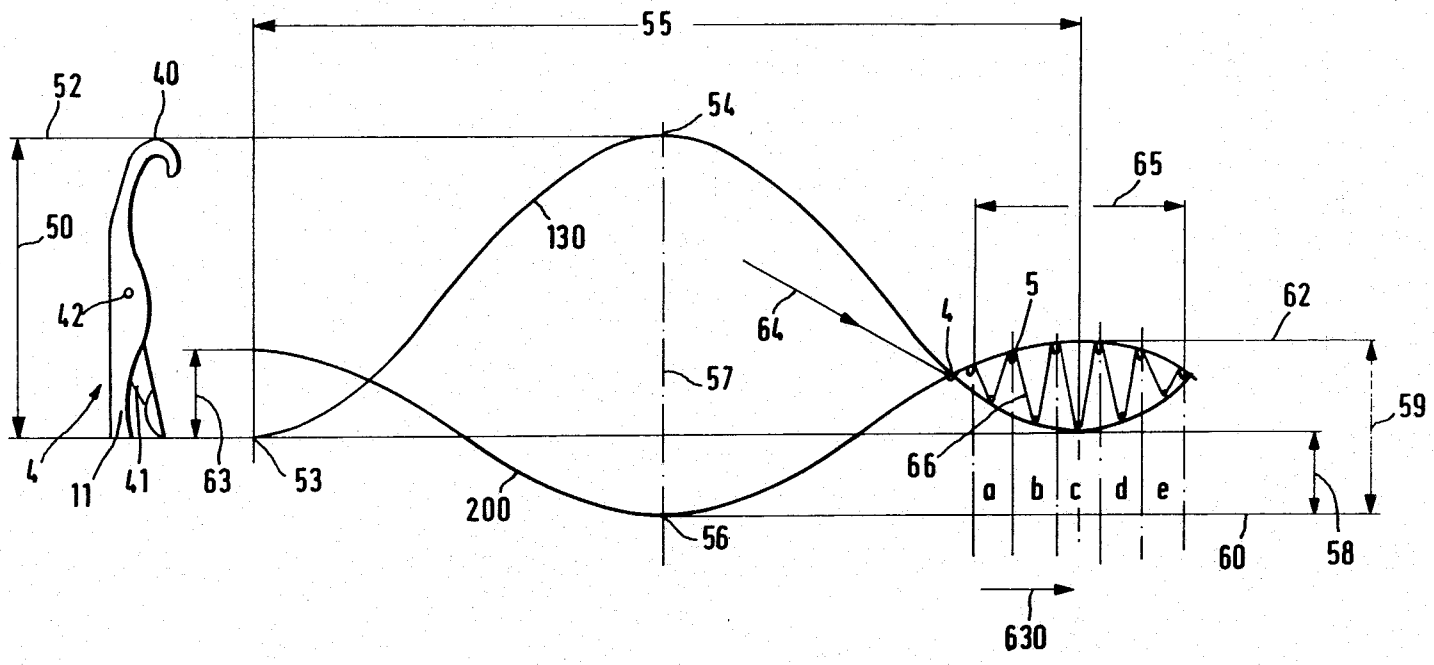

The needle cam curve 130 and the sinker cam curve 200 in the embodiment of FIG. 3 are the same as in FIG. 2. Identical elements are therefore identified by the same reference numerals. Compared with the arrangement of FIG. 2, in FIG. 3 the latch needles 4 and the locking-in and knockover sinkers 5 in the loop forming zone 65 have shifted Laterally by one-half a needle or sinker slot with respect to the cam curves 130, 200. This has been attained by a corresponding rotation of the cam casing 3 relative to the needle cylinder 1 in FIG. 1. As a result of this offset, the loop length in the loop forming zone 65 is greatest precisely at the zenith of the needle cam curve 130 (segment c).

From a comparison of the course of the yarn in the loop forming zone 65 of FIGS. 2 and 3, it is apparent that the above offset between the cam curves 130, 200 and the latch needles 4 and the locking-in and knockover sinkers 5 can be a means of varying the loop formation and hence the (inherently small) quantity of yarn that is robbed back from the already formed loops when the yarn is drawn out into the new loop. Depending on the pattern of the goods to be made and on the yarns used, this offset can be selected such that optimal conditions for a given purpose are attained.

The quality of the goods can also be varied by shifting either the sinker cam curve 200 or the needle cam curve 130 in the vertical direction; the distance 63 that corresponds to the maximal loop length will change accordingly. To this end, the eccentric adjusting mechanism 31 of FIG. 1 is provided, which enables an adjustment of the sinker cam curve 22 relative to the needle cam curve 130.

With this kind of vertical adjustment, the safe distance 58 changes as well. However, this distance is selected such that even at the maximal loop length, sufficient safety always remains for locking in the yarn when the needle is fully raised.

Figure 4:
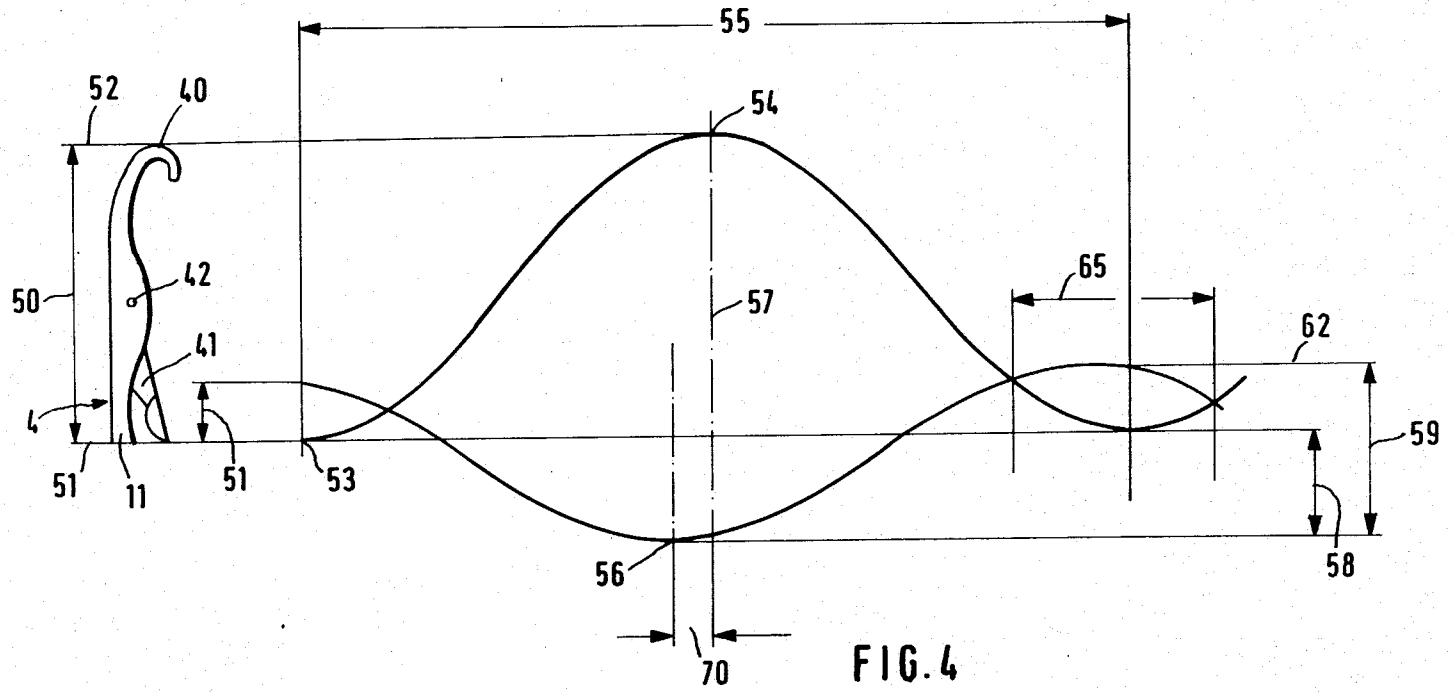

The conditions prevailing if the needle cam curve 130 and sinker cam curve 200 are vertically shifted relative to one another are shown in FIG. 4. For the sake of simplicity, this drawing shows only the needle cam curve 130 and the sinker cam curve 200 corresponding to FIGS. 2, 3, dispensing with an illustration of the yarn course and the positions of the needles and locking-in and knockover sinkers. Identical elements are again identified in this drawing figure by the same reference numerals as in FIGS. 2 and 3.

In comparison with FIG. 2, FIG. 4 shows that the sinker path 59 remains unchanged, while the safe distance 58 has necessarily become longer, and the loop length 63 is shorter because of the vertical shift of the sinker cam curve 200.

In addition to the vertical adjustment, FIG. 4 also shows the sinker cam curve 22 shifted in the circumferential direction of the needle cylinder 1 by an amount 70, while on the other hand the two cam curves 130, 200 retain their same shape without change. The amount of the offset 70 may be larger or smaller than what is shown in FIG. 4; it may also be located to the right with respect to the vertical line 57. This makes it possible to vary the yarn course in the loop forming zone 65, so as to attain the most favorable loop formation for the intended pattern of the goods and for the yarn qualities used.

Figure 5:
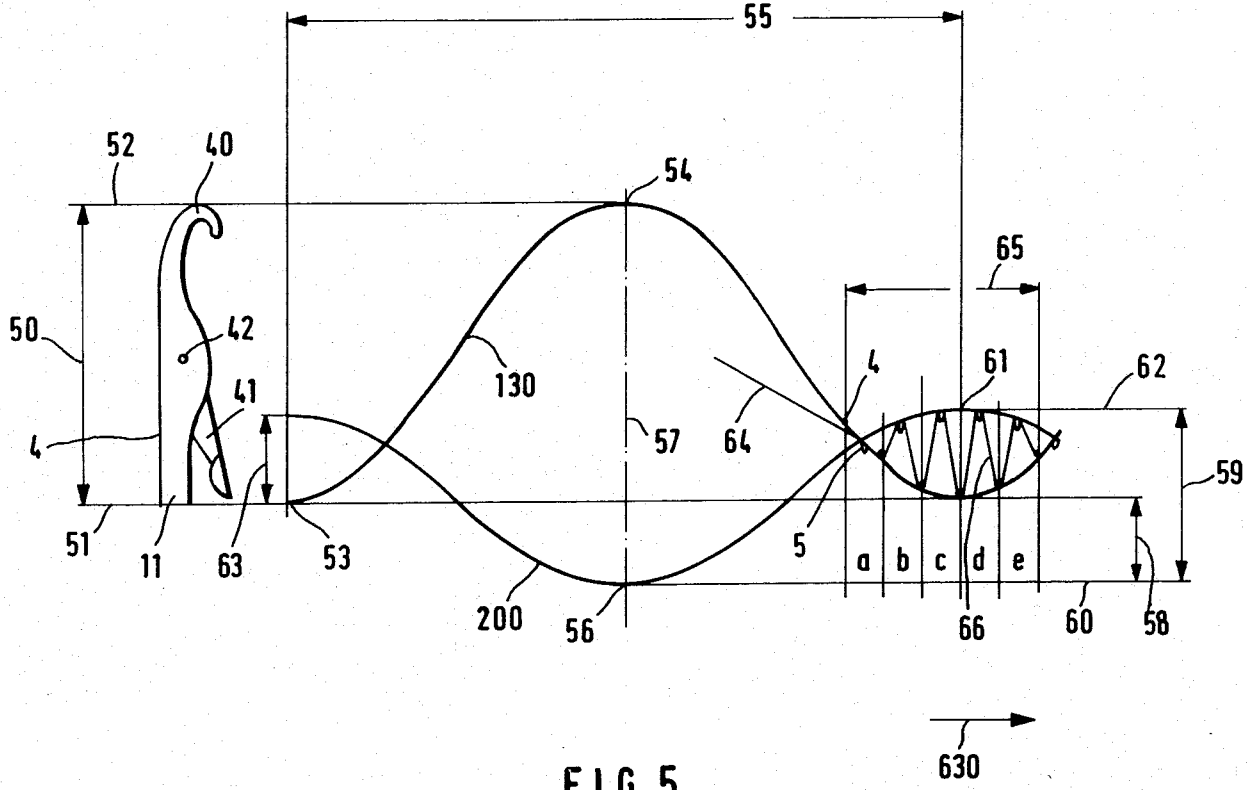

FIG. 5 shows the same arrangement as FIG. 2, but with a shortened feed system length, that is, with a shorter period length 55 of the sinusoidal needle cam curve 130 and of the likewise sinusoidal sinker cam curve 200. The needle and sinker slot spacing is the same as in FIG. 3.

The shortening of the period length 55 results in different loop forming angles, as the drawing shows, yet without changing anything in the fundamental situation. In particular, the movement of the latch needles 4 and the locking-in and knockover sinkers 5 is always along a harmonic curve.

Identical elements in FIG. 5 and in FIG. 3 are identified by the same reference numerals in both figures.

FIG. 6 shows the same needle cam curve 130 as that shown in FIG. 5, and the period length 55 is also the same. The latch needles used here, however, have a shorter flipping distance 50, with the result that because the needle path 50*a* is unchanged in its length, the safe distance 58 needs to be only as long as the required maximal loop length in the goods to be knitted (the distances 58, 63 of FIG. 5 become of equal length here).

The sinker cam curve 200 has a particularly flat course, as the drawing shows; as a result, the noise level of a high-speed knitting machine of this type can be kept particularly low.

In principle, it would also be possible to make the needle path 51*a* shorter than the flipping length 50, and to make the sinker path 59 correspondingly longer.

In FIG. 6, once again elements identical to those of FIG. 5 are identified by the same reference numerals.

The needle cam curves 130 and sinker cam curves 200 shown in FIGS. 2–6 are purely sine curves. To simplify manufacture of the needle and sinker cam parts, and also for technical knitting reasons, it may occasionally be suitable to approximate the sine form. In that case, naturally no irregularities or irregular zones must be allowed in the curve course, because they would cause excessively high acceleration or deceleration for the needles 4 or locking-in and knockover sinkers 5 controlled by the cam curves.

Examples of such approximate harmonic cam curves are given in FIG. 7, in which again elements identical to those of FIG. 5 are identified by the same reference numerals.

In the vicinity of the reversal points 53, 54, the needle cam curve 130 continues to be purely sinusoidal. The sinusoidal arc portion in the vicinity of the lower reversal point, or extreme point, 54 extends between the two points 71, 72, while the equally large sinusoidal arc portion in the vicinity of the lower reversal or extreme point 53 begins at 710, and only half of it is shown in FIG. 7. Between the points 71, 710 or 72, 720, that is, on the flanks of the needle cam curve 130, the sine curve is approximated with straight lines, which are tangents to the adjoining sinusoidal arc portions at 71, 710 or 72, 720. Instead of these straight connecting portions, connecting portions having a slight, steady curvature could also be used, if that should be appropriate in a particular instance. In any case, however, a tangent, stepless merging with the adjacent sine arc portions in the vicinity of the movement reversal points must always be assured.

A further deviation from the sine form of the needle cam curve 130 and sinker cam curve 200 is also provided in the loop forming zone 65. Between two successive sinusoidal cam curve portions, each encompassing one feed system and period length 55, the cam curves 130, 200 are provided over a length 75 with horizontally extending straight curved portions 200*a* and 130*a*, which merge steplessly, in the form of tangents, with the adjacent sinusoidal arc portions. The straight cam curve portions 130*a* and 200*a* are located inside the loop forming zone 65, at the points of maximal amplitude of the needle cam curve 130 and sinker cam curve 200 respectively. They make it possible to maintain the length of the fully drawn-out loop 66 (see FIG. 5, for example) over a predetermined region in the loop forming zone 65. The straight curve portions 130*a*, 200*a* may inherently be of any desired length to suit given situations; as a rule, their length is on the order of ½ to 2 needle or sinker slot spacings.

In principle, it is also possible for only one of the two cam curves, 130 or 200, to have this kind of curve portion 130*a* or 200*a* within the loop forming zone 65, while the other curve portion instead has a curved arc portion over the length 75, which by approximation augments the harmonic curve form.

For the sake of better explanation of the sinusoidal arc portions of the needle cam curve 130 and the sinker cam curve 200, FIG. 7, at 76, shows the circular arc for both these cam curves, from the projection of which arc the sine curves are derived.

The control of the latch needles 4 and the locking-in and knockover sinkers 5 of a circular knitting machine shown in FIGS. 1–7 can also be applied to knitting or jersey knitting machines operating with other types of needles, such as pointed needles or compound needles. Its application to the control of compound needles is illustrated in FIGS. 8, 9. FIG. 8 shows only the individual cam curves in a manner similar to FIG. 3, while FIG. 9 illustrates the relative position of the compound needles and the associated locking-in and knockover sinkers during the loop forming process.

The basic design of a knitting machine that uses such compound needles, along with the needle beds, needle cams and the like, is known per se and need not be explained in detail here. The situation is basically similar to that in the circular knitting machine of FIG. 1, except that below the needle cam 15 there is also a further slider cam, controlling the slider part of the compound needles, located in the cam casing 3; its cam race is for instance located where the cam race 13*a* is shown in FIG. 1 and cooperates with corresponding butts of the slider.

The needle cam curve 130 and the sinker cam curve 200 of the compound needles, one of which is shown in detail at 4*a* in FIG. 8, are the same as in the exemplary embodiment of FIG. 6. Both are sinusoidal curves; identical reference numerals identify identical elements. The two cam curves 130, 200 may be shifted both vertically and horizontally with respect to one another, as already explained above, without changing the shape of the curve itself.

In addition to the sinusoidal needle cam curve 130 and the likewise sinusoidal sinker cam curve 200, however, there is also a third slider cam curve 300, which serves to control the slider part 301 of the compound needles 41.

Because of given technical aspects in the operation of a compound needle while knitting, the slider cam curve 300 is subtantially operative only in the second half of the period length 55, corresponding to the descending half-sine wave of the needle cam curve 130, as FIG. 8 shows. In this area, the slider cam curve is a purely harmonic one, i.e., a sine curve.

In order to prevent overly fast acceleration of the slider 301, in particular at the beginning of the operation of closing the compound needles 4*a*, the slider cam curve may also have the course shown at 300*a* in dashed lines in its ascending segment; this course, beginning approximately at the first one-fourth of the period length 55, produces particularly gentle acceleration of the sliders 301.

The relative position of the compound needle 41, the slider part 301 and the adjacent locking-in and knockover sinkers 5 with operation controlled by the cam curves 130, 200, 300 is illustrated in FIG. 9, in which the various positions of these loop forming devices are shown in accordance with points A–G on the cam curves 130, 200, 300 shown in FIG. 8:

At point A, the compound needle 4*a* is located in its lowermost position. The hook 40 is closed by the slider 301. The loop forming edge 170 of the locking-in and knockover sinker 5 is located above the needle hook 40 by a distance that corresponds to the greatest loop length 63. The loop formation process is completed.

At point B, the compound needle 4*a* is already executing its raising movement, while the locking-in and knockover sinker 5 is executing an opposite downward lowering movement with respect to point A. The slider 301 has not changed its position.

At point C, the compound needle 4a is almost fully raised; the locking-in and knockover sinker 5 has dropped further, in contrary motion, as compared with point B, while the slider 301 is still retained stationary.

At point D, finally, the compound needle 4*a* has attained its fully raised position corresponding to the extreme point 54 of the sine curve, while the locking-in and knockover sinker 5 has correspondingly reached its lowermost extreme point 56 on the associated sine curve. The slider 310 is still retained in its lower position, without change.

At point E, the compound needle 4a has drawn in the yarn 64 with its hook 40; it has begun its lowering movement while the locking-in and knockover sinker 5 is raised in the opposite direction. The slider 301 is now raised as well and begins to close the needle.

At point F, the compound needle is lowered by about one-half the distance from its fully raised position, while the locking-in and knockover sinker 5 is likewise raised by about one-half the distance from its lowermost position. The slider 301 is fully raised and has closed the needle hook 40. Casting off of the loop onto the slider 301 now takes place.

At point G, finally, the same situation as at point A has been attained. The loop forming process is completed.

The needle and sinker control described above in terms of latch needles and compound needles is applicable in principle not only to circular knitting machines having locking-in and knockover sinkers, but also to flat bed machines and in general to knitting and jersey knit machines of any type that use movable sinkers. Among these are, for instance, knitting machines of the generic type of German Patent DE-PS No. 24 08 924, which are equipped solely with loop forming sinkers.

I claim:

1. Knitting machine having at least one needle bed equipped with longitudinally displaceable needles controlled by a needle cam curve, sinkers, and a sinker cam curve controlling the sinkers, and protruding between the needles, the sinkers being movably supported in at least the longitudinal direction of the needles and being controlled such that at a given feed, after the locking in of the yarn, they are moved counter the lowering movement of the associated needles and after casting off of the loop are moved counter to the needle raising movement, the needles and sinker cam surves having adjoining steadily curved are portions wherein sid portions in the needle can curve are sinusoidal and merge steplessly with one another, and wherein, the sinker cam curve (220) at least in the loop forming zone (65) is shaped in substantially sinusoidal form.

2. Knitting machine according to claim 1, wherein the needle cam curve (130) and the sinker cam curve (200) are substantially continuously sinusoidal with the same period length (55).

3. Knitting machine according to claim 2, wherein the needle and sinker cam curves (130, 200) are located with their respective maximum amplitude values (54, 56) on a common line (57) in the longitudinal direction of the needles.

4. Knitting machine according to claim 1, wherein the needle and sinker cam curves (130, 200) are displaceable in the axial direction relative to one another.

5. Knitting machine according to claim 4, wherein the needle and sinker cam curves (130, 200) are offset from one another by a predetermined amount (70) in the axial direction.

6. Knitting machine according to claim 4, wherein the two cam curves (130, 200) are offset from one another by the amount of two to three needle slot spacings.

7. Knitting machine according to claim 1, wherein at least the needle cam curve (130) in the loop forming zone (65) is provided with a substantially straight curve portion (130*a*) merging steplessly with the adjacent arc portion, the substantially straight portion being located in the region of maximal amplitude.

8. Knitting machine according to claim 1, wherein the needle and/or sinker cam curve (130, 200), at least in the vicinity of the reversal of movement of the needles (4) or sinkers (5) it controls, which vicinity is located outside the loop forming zone (65), has sinusoidal arc portions, and these arc portions are joined together by substantially straight curve portions (71–710; 72–720).

9. Knitting machine according to claim 2, wherein the period length (55) of the sinusoidal needle and sinker cam curves (130, 200) is approximately equal to one-half the length of one feed system.

10. Knitting machine according to claim 2, wherein the period length (55) of the sinusoidal needle and sinker cam curves (130, 200) is approximately equal to the length of one feed system.

11. Knitting machine according to claim 2, wherein the amplitude of the substantially sinusoidal needle cam curve (130) is equal to or greater than the amplitude of the sinker curve (200).

12. Knitting machine according to claim 1, wherein the needles are latch needles (4) and the needle raising movement path is approximately equal to or shorter than the flipping length (50) of the latch of the needles (4).

13. Knitting machine according to claim 1, wherein the needles are compound needles (**4*a*) and the slider (301) is controlled by a slider cam curve (300**) that is intermittently substantially sinusoidal.

14. Knitting machine according to claim 13, wherein one-half the period length of the half-sine wave of the slider cam curve (**300*a*) controlling the raising movement of the slider (301) is approximately twice as long as one-half the period length of the half-sine wave controlling the lowering movement of the slider (301**).

* * * * *